US005091944A

United States Patent [19]

Takahashi

[11] Patent Number: 5,091,944

[45] Date of Patent: Feb. 25, 1992

[54] APPARATUS FOR LINEAR PREDICTIVE CODING AND DECODING OF SPEECH USING RESIDUAL WAVE FORM TIME-ACCESS COMPRESSION

[75] Inventor: Shinya Takahashi, Kamakura, Japan

[73] Assignee: Mitsubishi Denki Kabushiki Kaisha, Tokyo, Japan

[21] Appl. No.: 511,100

[22] Filed: Apr. 19, 1990

[30] Foreign Application Priority Data

Apr. 21, 1989 [JP] Japan ..... 1-102716

[51] Int. Cl.[5] ..... G10L 7/02

[52] U.S. Cl. ..... 381/36; 381/38

[58] Field of Search ..... 381/29–41; 364/513.5

[56] References Cited

U.S. PATENT DOCUMENTS

| | | | |
|---|---|---|---|
| 4,220,819 | 9/1980 | Atal | 381/38 |
| 4,720,861 | 1/1988 | Bertrand | 381/36 |
| 4,797,926 | 1/1989 | Bronson et al. | 381/37 |
| 4,827,517 | 5/1989 | Atal et al. | 381/41 |
| 4,985,923 | 1/1991 | Ichikawa et al. | 381/38 |

FOREIGN PATENT DOCUMENTS 8704290 7/1987 PCT Int'l Appl. .

OTHER PUBLICATIONS

Cox et al., "An Implementation of Time Domain Harmonic Scaling With Application to Speech Coding", IEEE, 1982, pp. 4G.1.1–4G.1.4.

*Primary Examiner*—Emanuel S. Kemeny
*Assistant Examiner*—Michelle Doerrler
*Attorney, Agent, or Firm*—Wolf, Greenfield & Sacks

[57] ABSTRACT

A speech coding and decoding apparatus for use in linear predictive coding of a speech signal includes coding apparatus having a pitch analyzing element for separating an analysis frame into one or more blocks and calculating the strength of correlativity between pitch periods of a residual waveform in each block. A residual partially compresing element compresses the time axis of the residual waveform in a block having a high correlativity strength. A residual quantizing element quantizes the compressed residual waveform while preferentially allotting quantization allotment bits to the compressed portion of the residual waveform. Decoding apparatus includes a residual inverse quantizing element for inversely quantizing the residual waveform by the same bit allotment. A residual partially expanding element expands the compressed portion of the residual waveform to its original length and supplies it to a linear predictive synthesis filter.

10 Claims, 7 Drawing Sheets

APPARATUS FOR LINEAR PREDICTIVE CODING AND DECODING OF SPEECH USING RESIDUAL WAVE FORM TIME-ACCESS COMPRESSION

BACKGROUND OF THE INVENTION

1. Field of the Invention

The present invention relates to the improvement in a method of compressing and expanding the time axis of a linear predictive residual waveform in a speech coding and decoding apparatus used for transmitting or storing an input speech signal in the form of a digital signal.

2. Description of the Prior Art

A method of extracting a linear predictive residual waveform (hereinunder referred to as "residual waveform") from a speech waveform input after linear predictive analysis and quantizing it together with the linear predictive coefficient, etc. is one of the high-efficiency compression coding methods. A speech coding and decoding apparatus such as that shown in FIGS. 4A and 4B which adopts this method together with a method of compressing the time axis of a residual waveform utilizing a pitch period is conventionally known. The apparatus shown in FIGS. 4A and 4B is similar to the apparatus described in "Algorithm of 8-16 Kbps Residual Compressing Method (TOR) Algorithm Utilizing Pitch Information", the Transactions of Acoustical Society of Japan 3-2-1 (March, 1986).

FIG. 4A shows a coding portion and FIG. 4B a decoding portion. In these drawings, the reference numeral 1 represents an input speech waveform, 2 a linear predictive inverse filtering means, 3 a linear predictive analyzing means, 4 a residual waveform, 5 a linear predictive coefficient, 23 a pitch extracting means, 8 a pitch period, 24 a residual thinning means, 25 a voiced/unvoiced judging means, 26 voiced/unvoiced judging information, 27 a thinned residual waveform, 28 a residual quantizing means, 13 a quantized residual waveform, 14 a multiplexing means, 15 a transmission path, 16 a separating means, 29 a residual inverse quantizing means, 30 a inverse quantized residual waveform, 31 a residual reproducing means, 20 a reproduced residual waveform, 21 a linear predictive synthetic filtering means and 22 a synthesized speech waveform.

The operation of the conventional apparatus will be explained hereinunder.

The coding portion shown in FIG. 4A will first be explained.

The input speech waveform 1 (time series of discrete value data) is subjected to linear predictive analysis by the linear predictive analyzing means 3 for each analysis frame (hereinunder referred to as "frame") having a fixed length to obtain a linear predictive coefficient. The linear predictive analyzing means 3 outputs the linear predictive coefficient 5 obtained to the linear predictive inverse filtering means 2 and the multiplexing means 14. The linear predictive inverse filtering means 2 processes the linear predictive inverse filtering operation on the input speech waveform 1 for each frame by using the linear predictive coefficient 5, thereby obtaining the residual waveform 4. The pitch extracting means 23 calculates the pitch period 8 from the residual waveform 4 and the input speech waveform 1 of the corresponding frame, for example, using an AMDF method and an auto-correlation method together. The voiced/unvoiced judging means 25 judges whether the input speech waveform 1 is voiced or unvoiced on the basis of the power value of the residual waveform 4 of the corresponding frame and the AMDF value (in accordance with the AMDF method) obtained by the pitch extracting means 23, and outputs the result as the voiced/unvoiced information 26. The residual thinning means 24 outputs a representative residual waveform 27 by thinning the residual waveform 4 by utilizing the pitch period 8 of the residual waveform 4 of the frame when it is judged to be voiced. An example of the thinning operation on a voiced waveform of the residual thinning means 24 is shown in FIG. 5.

In FIG. 5, the waveform (a) represents a residual waveform. The residual thinning means 24 extracts the portion (the square portion bestriding between the current frame and the next frame in the waveform (a)) of the waveform in which a residual pulse having the maximum amplitude is contained and the sum of the absolute values of the amplitudes of the continuous predetermined number of residue pulses is the maximum from the residual waveform in the pitch section (section width: P) which extends to the next frame, and outputs the residual waveform in the portion as a representative residual waveform. The waveforms (b) in FIG. 5 are representative residual waveforms of the precedent frame and the current frame.

When the voiced/unvoiced judging means 25 judges the waveform to be an unvoiced waveform, the residual thinning means 24 sorts the residual pulses in the order of the amplitude, extracts a predetermined number of residual pulses and outputs them as the representative residual waveform 27.

In accordance with the voiced/unvoiced judging information 26, the residual quantizing means 28 quantizes the representative residual waveforms 27 output from the residual thinning means 24 by quantization bit allotment which is preset and is different depending upon whether the waveform is voiced or unvoiced and outputs the quantized residual 13. The multiplexing means 14 multiplexes the pitch period 8, the voiced/unvoiced judging information 26, the quantized residual 13 and the linear predictive coefficient 5, and outputs the result to the transmission path 15 as coded speech information.

The decoding portion shown in FIG. 4B will now be explained.

The separating means 16 separates the coded speech information supplied from the transmission path 15 into the pitch period 8, the voiced/unvoiced judging information 26, the quantized residual 13 and the linear predictive coefficient 5. The residual inverse quantizing means 29 inversely quantizes the quantized residual 13 by allotting bits by using the voiced/unvoiced judging information 26 in the same way as in the quantization by the residual quantization means 28, and outputs the result as the representative residual waveform 30. When the voiced/unvoiced judging information 26 judges the waveform of the current frame to be a voiced waveform, the residual reproducing means 31 repeats the representative residual waveform 30 in the current frame at every pitch period 8 while interpolating the residual waveform reproduced in the precedent frame and the amplitude thereof, thereby reproducing the residual in the entire frame. FIG. 5 shows an example of the operation of reproducing a residual of a voiced speech performed by the residual reproducing means 31. The residual reproducing means 31 repeats the representative residual waveform in the current frame indicated by the symbol (b) in FIG. 5 at every pitch period 8 while interpolating the residual waveform reproduced in the precedent frame and the amplitude thereof, thereby obtaining the reproduced residual waveform (c). On the other hand, when the voiced/unvoiced judging information 26 judges the waveform of the current frame to be an unvoiced waveform, the residual reproducing means 31 restore the pulse of the representative residual waveform 30 to the position before thinning, and reproduces the residual waveform.

The residual reproducing means 31 outputs the residual waveform as the reproduced residual waveform 20. The linear predictive synthetic filtering means 21 synthesizes the speech waveform of the frame from the reproduced residual waveform 20 by linear predictive synthetic filtering using the linear predictive coefficient 5, and outputs the synthesized speech waveform 22.

A conventional speech coding and decoding apparatus, however, has the following problems. When the residual of a voiced sound is reproduced by a decoding portion, the representative residual waveform of the current frame is repeated at every pitch period while interpolating the representative residual waveform and the amplitude thereof of the precedent frame, as described above. Therefore, in a pitch section which is reproduced by interpolation and which has only a small correlation between the original residual waveform and the representative residual waveform, a large distortion is produced between the original waveform and the reproduced residual waveform, thereby deteriorating the quality of the reproduced speech waveform.

In addition, since the residual waveform of a voiced speech which bestrides between the current frame and the next frame is thinned and reproduced by the decoding portion, if the pitch period of the current frame is erroneously transmitted due to a bit error produced in the transmission path, a distortion of the reproduced residual waveform caused by the error affects the antecedent frames. That is, there is low proof of an error in the transmission path.

SUMMARY OF THE INVENTION

Accordingly, it is an object of the present invention to eliminate the above-described problems in the prior art and to provide a speech coding and decoding apparatus which compresses the time axis only at the portion which has a large correlation between adjacent pitch sections by utilizing the pitch period of a residual waveform of a voiced speech and completes the compression of the time axis and the reproduction of the residual waveform within the current frame.

To achieve this aim, a speech coding and decoding apparatus according to the present invention comprises a coding portion and a decoding portion. The coding portion is composed of: a pitch analyzing means for separating one frame into at least one block and obtaining the strength of the correlativity between the pitch periods of the residual waveform in each block; a residual partially compressing means for compressing the time axis of the residual waveform in the block having a high correlativity strength and in the vicinity within the frame thereof by utilizing the pitch period; and a residual quantizing means for quantizing the residual waveform compressed by the residual partially compressing means while preferentially allotting quantization allotting bits to the compressed portion. The decoding portion is composed of: a residual inverse quantizing means for inversely quantizing the residual waveform by the same bit allotment in residual quantizing means in the coding portion; and a residual partially expanding means for expanding the compressed portion of the inversely quantized residual waveform to the original length.

The pitch analyzing means in the present invention divides one frame into at least one block, obtains the strength of the correlativity between the pitch periods of the residual waveform in each block. The residual partially compressing means compresses the time axis by compressing the residual waveform for two pitch sections into the residual waveform for one pitch section in the block having a high correlativity strength and in the vicinity within the frame thereof by average processing. The residual quantizing means quantizes the residual waveform compressed by the residual partially compressing means while preferentially allotting quantization allotting bits to the compressed portion. The residual inverse quantizing means inversely quantizes the quantized residual waveform by the same bit allotment in the residual quantizing means in the coding portion and the residual partially expanding means expands the compressed portion of the inversely quantized residual waveform by repeating the portion for one pitch section twice.

As described above, according to the present invention, since the object of time-axis compression is only the portion which has a large correlation between adjacent pitch period sections and the residual waveform for adjacent two pitch period sections is compressed into the residual waveform for one pitch period section by averaging processing, it is possible to retain the configuration of the residual waveform before the compression. In addition, since quantizing bits are preferentially allotted to the compressed portion which has twice as much information as the other portion has so as to reduce errors in quantization, the distortion produced between the reproduced residual waveform expanded by the expansion of the time axis and the residual waveform before the compression is reduced, thereby producing a reproduced s waveform having a good quality.

Furthermore, according to the present invention, since the time-axis compression and expansion processing of the residual waveform in a frame is completed within that frame, the distortion of the reproduced residual waveform due to the transmission error of the pitch period is confined to the corresponding frame, thereby enhancing the proof of transmission error.

The above and other objects, features and advantages of the present invention will become clear from the following description of the preferred embodiment thereof, taken in conjunction with the accompanying drawings.

DESCRIPTION OF THE PREFERRED EMBODIMENTS

Figure 4A:
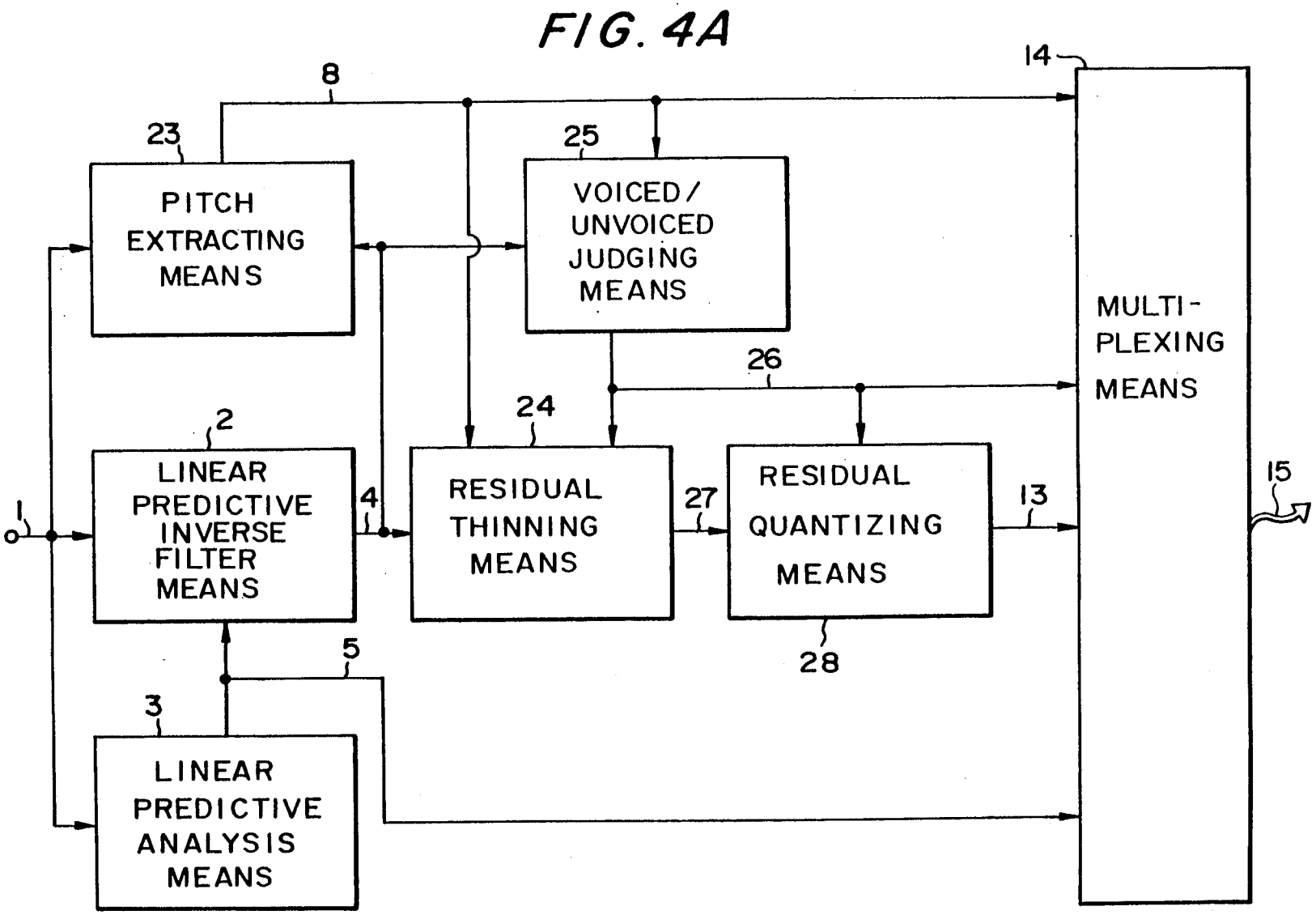
FIGS. 4A and 4B are block diagrams of a conventional coding and decoding apparatus.
Figure 4B:
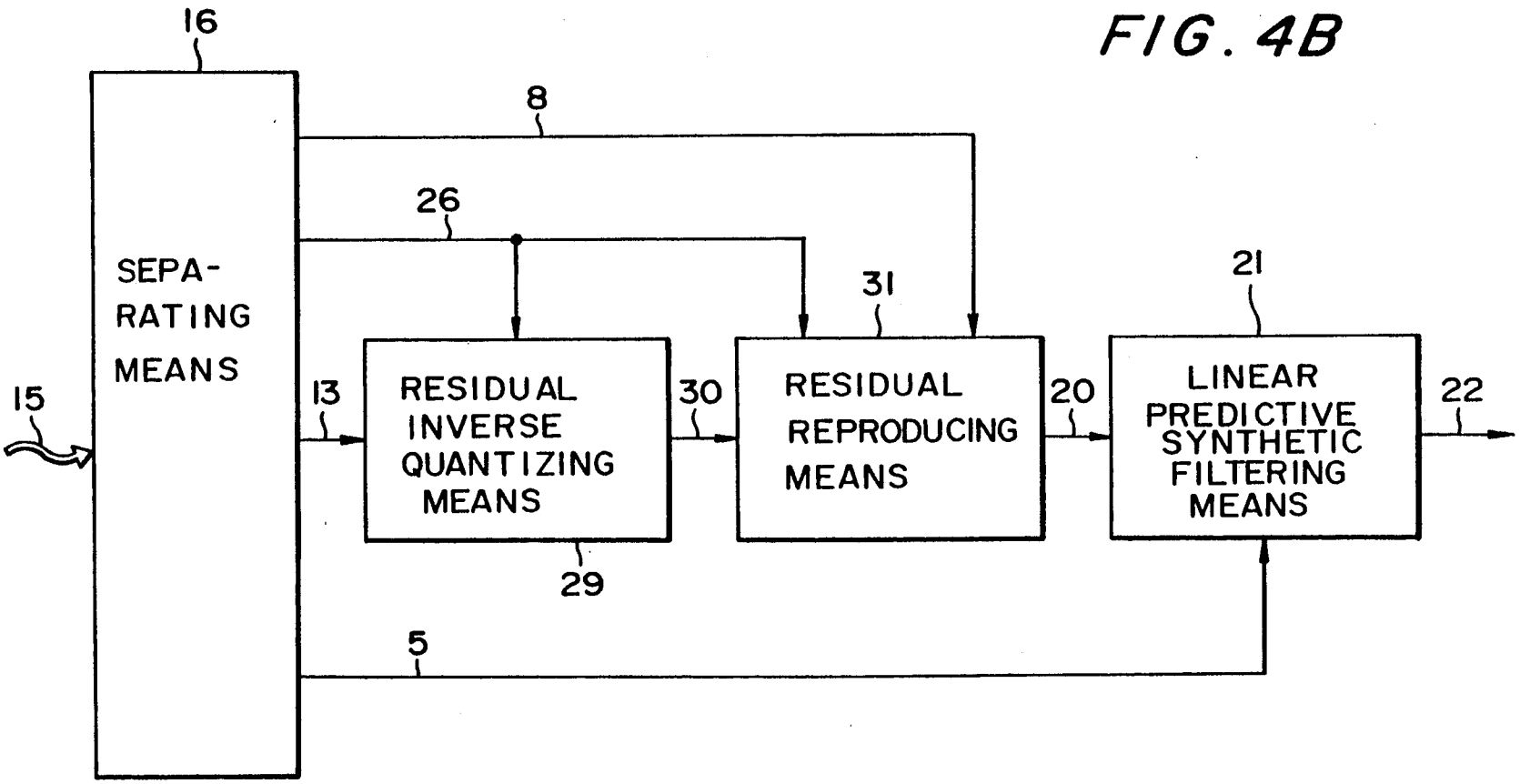
Figure 5:
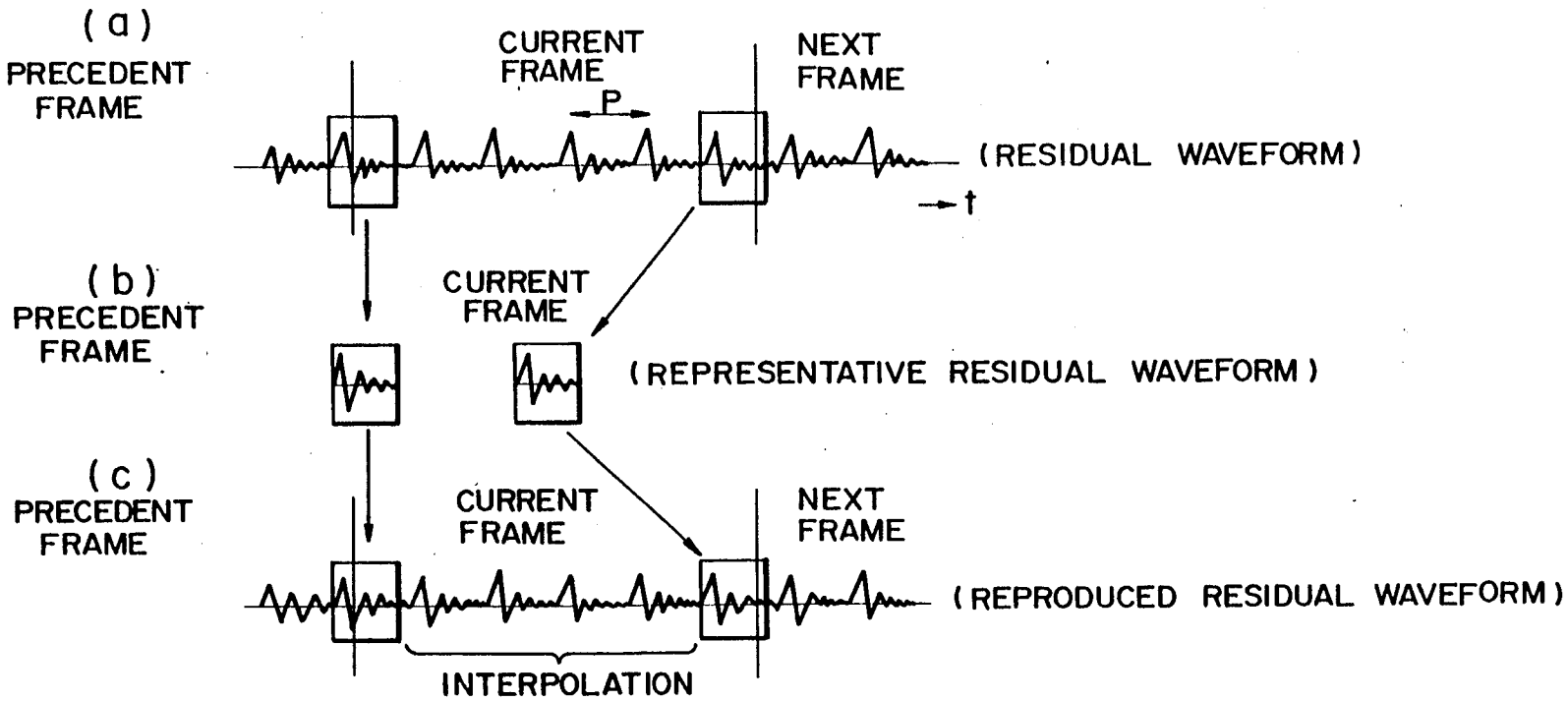
FIG. 5 is an explanatory view of the operation of the apparatus shown in FIGS. 4 A and 4B.

An embodiment of the present invention will be explained hereinunder with reference to FIGS. 1A and 1B. The same reference numerals are provided for the elements which are the same as those shown in FIG. 4, and explanation thereof will be omitted.

Figure 1A:
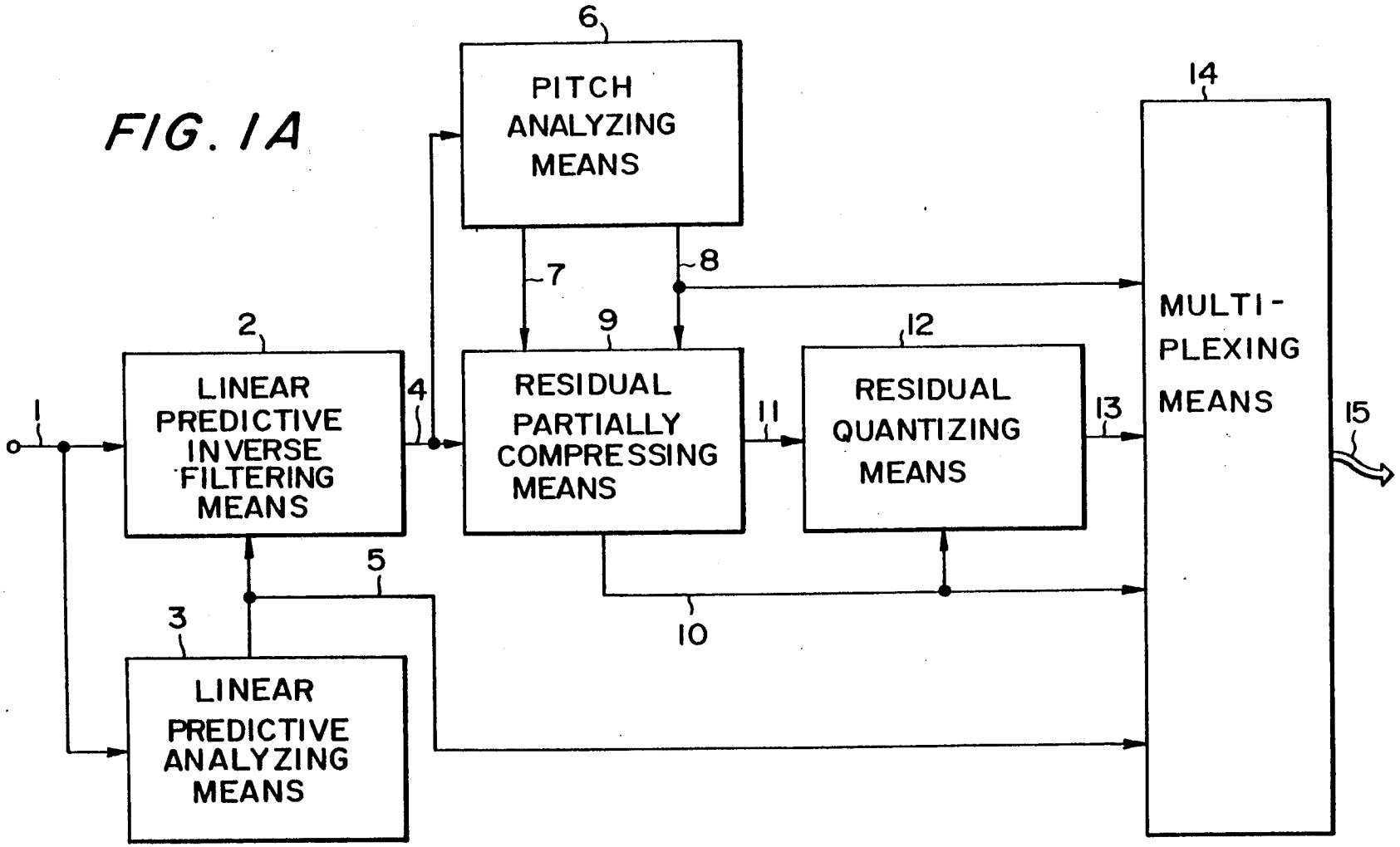
FIGS. 1A and 1B are block diagrams of an embodiment according to the present invention.
Figure 1B:
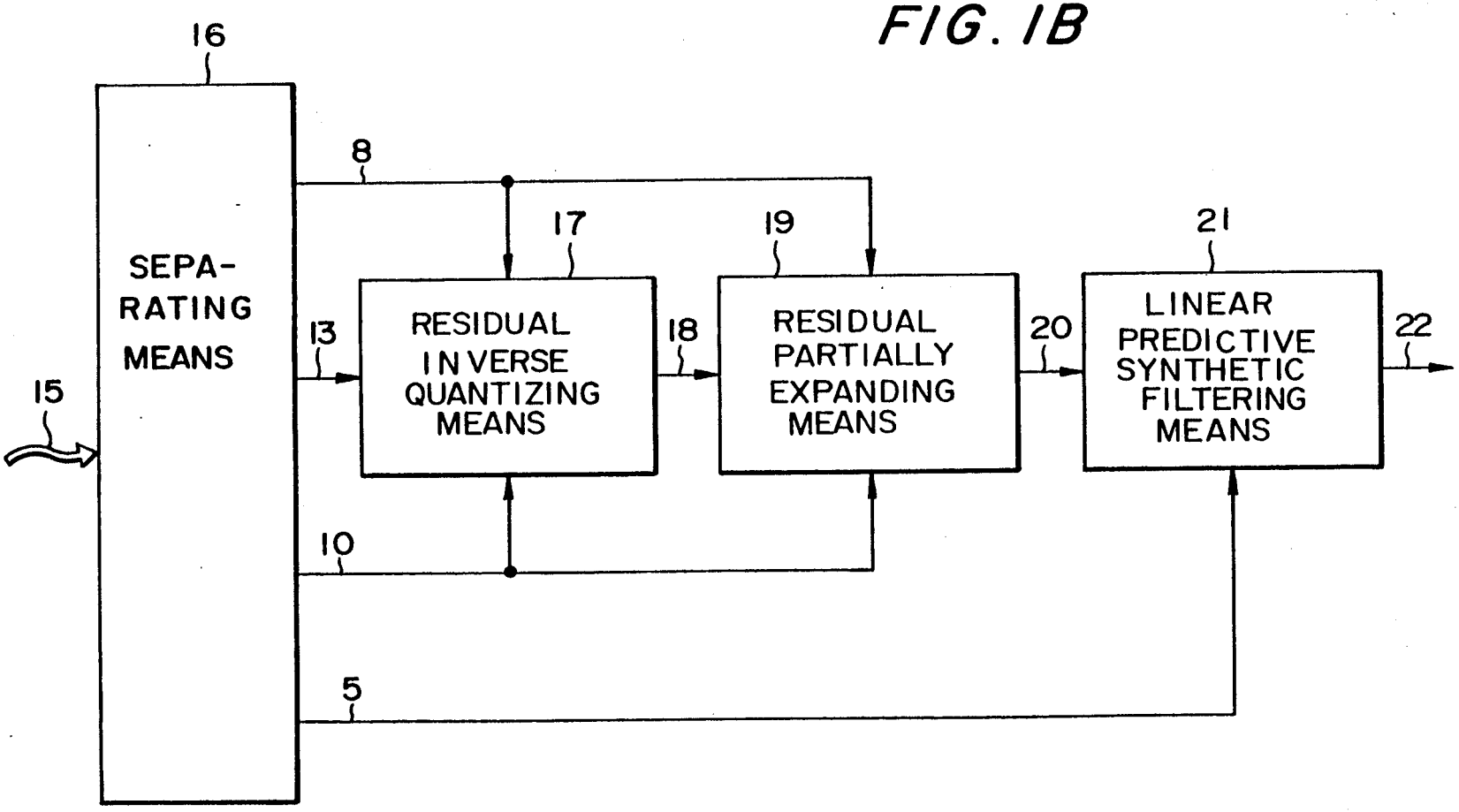

FIG. 1A shows a coding portion and FIG. 1B a decoding portion. The reference numeral 6 represents a pitch analyzing means, 8 a pitch period, 9 a residual partially compressing means, 10 compression control information, 11 a partially compressed residual waveform, 12 a residual quantizing means, 17 a residual inverse quantizing means, 18 a partially compressed residual waveform and 19 a residual partially expanding means.

The operation will now be explained.

The pitch analyzing means 6 obtains the pitch period length P of the residual waveform 4 over the entire part of the corresponding frame by auto-correlation, for example, and outputs the result as the pitch period 8. The analysis frame length N is set at not less than twice as large as the maximum pitch period of the speech of a human body in general. The pitch analyzing means 6 divides the frame into, for example, 2 blocks (block 1, block 2), and obtains for each block the correlative values $B_1$ and $B_2$ between the pitch period of the residual waveform. The correlative values $B_1$ and $B_2$ are output as the partial pitch correlative values 7.

The residual partially compressing means 9 compresses the time axis of the residual waveform 4 by using the partial pitch correlative values $B_1$, $B_2$ and the pitch period length P, and outputs the partially compressed residual waveform 11 and the compression control information 10. The details of the partial time-axis compression of the residual waveform executed by the residual partially compressing means 9 will be explained in the following.

When the partial pitch correlative value $B_1$ is larger than $B_2$, and $B_1$ is larger than a preset threshold value TH, the residual partially compressing means 9 compresses the time axis for the block 1. The residual waveform for adjacent two pitch sections is successively compressed into the residual waveform for one pitch section from the starting end of the frame toward the terminal end thereof by using the following equation (1):

$$RC_i=(RS_i+RS_{i+p})/2 \ (i=\phi, P-1) \quad (1)$$

wherein $RS_i$ represents the residual waveform for the corresponding two pitch sections, $RC_i$ the residual waveform after compression, and P a pitch period length. For the purpose of simplifying explanation, the range of the pointer i is assumed to be from $\phi$ to $P-1$. The compression processing is continued substantially until the starting end of the two-pitch section enters the block 2.

Figure 2A:
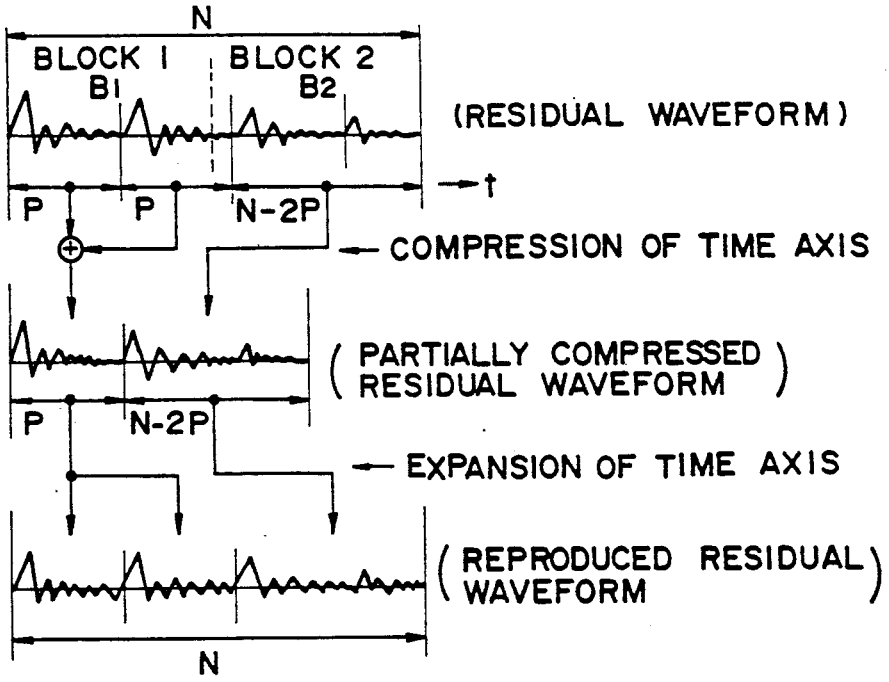
FIGS. 2A, 2B and 3A, 3B are explanatory views of the operation of the embodiment shown in FIG. 1.
Figure 2B:
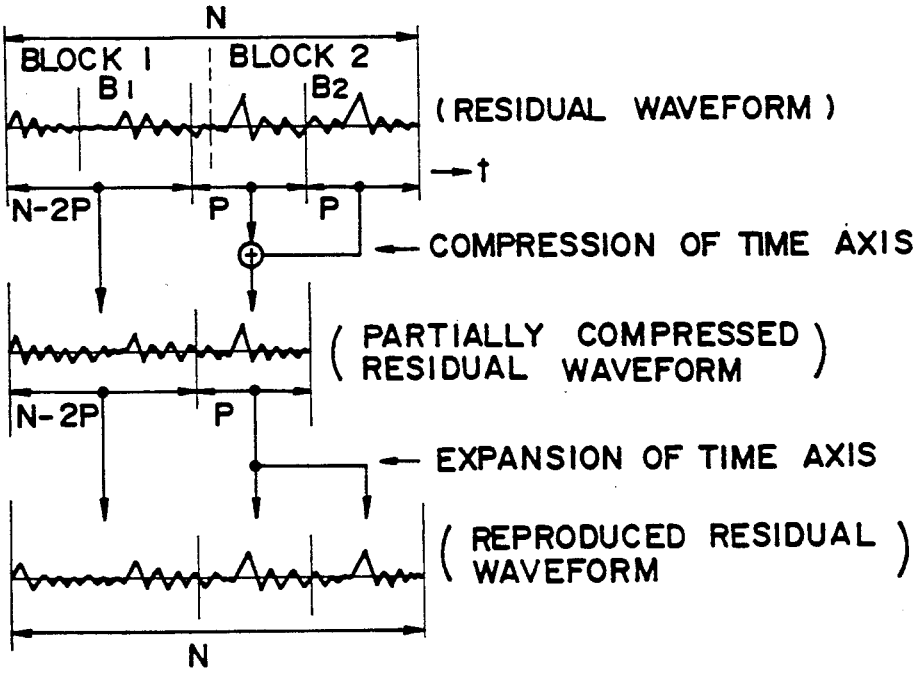
Figure 3A:
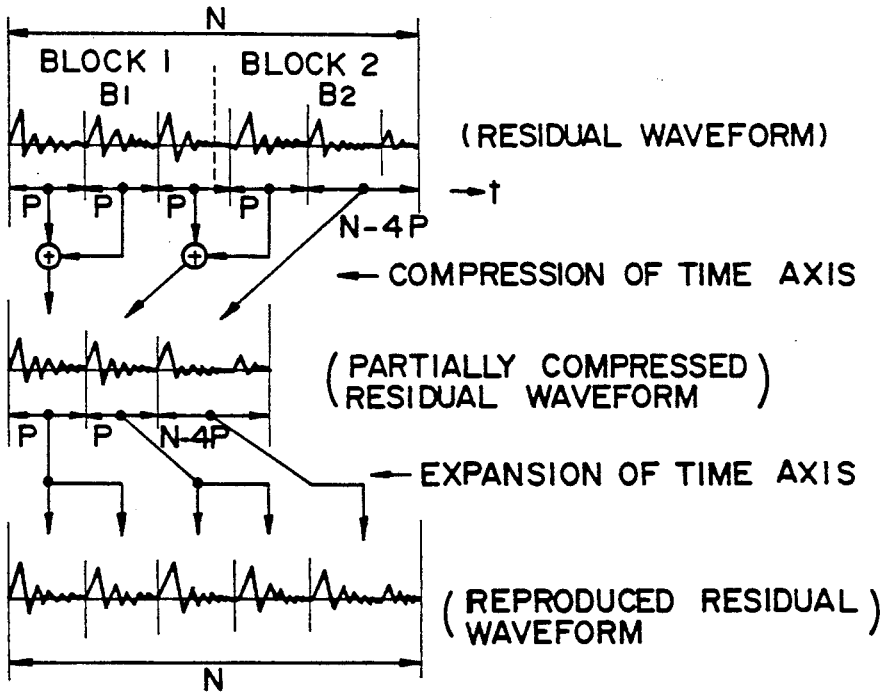
Figure 3B:
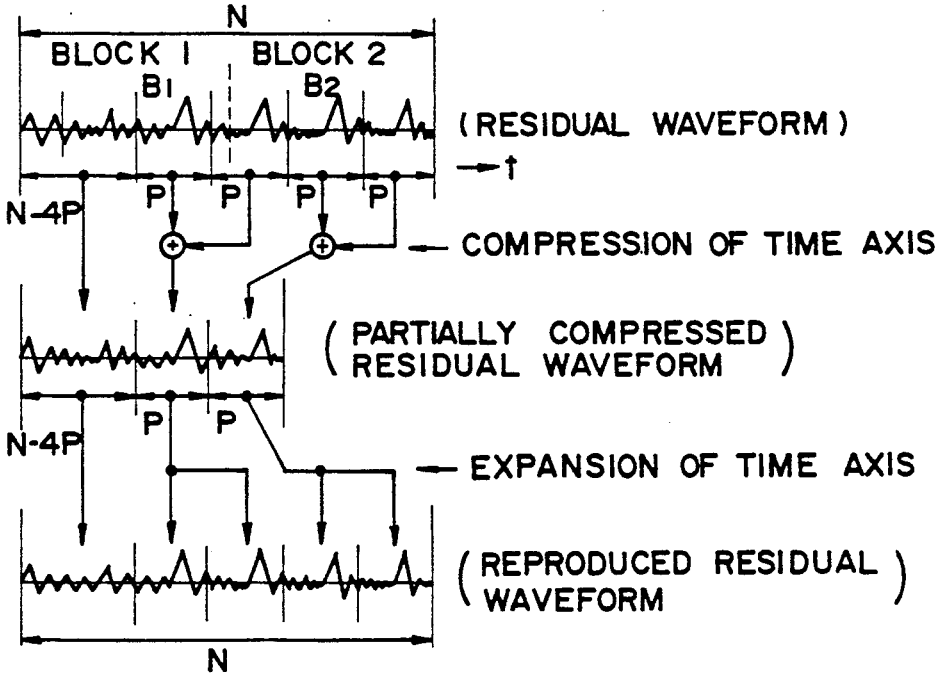

When the partial pitch correlative value $B_1$ is smaller than $B_2$, and $B_2$ is larger than the threshold value TH, the residual partially compressing means 9 compresses the time axis for the block 2. The residual waveform for adjacent two pitch sections is successively compressed into the residual waveform for one pitch section from the terminal end of the frame toward the starting end. The compression processing is continued substantially until the terminal end of the two-pitch section enters the block 1. FIGS. 2A, 2B and 3A, 3B show the operation of the residual partially compressing means 9. FIGS. 2A and 2B show the operation in the case of $N/4<P\leqq N/3$, wherein FIG. 2A shows the time-axis compression for the block 1 ($B_1>B_2$, and $B_1>TH$) and FIG. 2B shows the time-axis compression for the block 2 ($B_2>B_1$, and $B_2>TH$). FIGS. 3A and 3B show the operation in the case of $N/5<P\leqq N/4$, wherein FIG. 3A shows the time-axis compression for the block 1 and FIG. 3B shows the time-axis compression for the block 2.

When $B_1<TH$, and $B_2<TH$, the residual partially compressing means 9 does not execute time-axis compression but outputs it to the residual quantizing means 12 as it is. The residual partially compressing means 9 also outputs the information as to whether or not the residual waveform has been subjected to time-axis compression and the block number of the compressed residual waveform, if time-axis compression is executed, as the compression control information 10. The residual quantizing means 12 quantizes the partially compressed waveform 11 by utilizing the compression control information 10 and outputs the result as the quantized residual 13. The operation of the residual quantizing means 12 will be explained hereinunder.

When the input partially compressed residual waveform 11 is judged to have been subjected to time-axis compression from the compression control information 10, the residual quantizing means 12 quantizes the partially compressed residual waveform 11 by preferentially allotting quantization bits to the block which is judged to have been subjected to time-axis compression from the compression control information 10. It is now assumed that the same number of quantization bits as the number of residual samples in the frame before compression are apportioned for residual quantization. When time-axis compression is executed for the block 1, 1 bit is first allotted to each sample from the starting end toward the terminal end of the partially compressed residual waveform 11 in series. The partially compressed residual waveform 11 has a movable length, and if after 1 bit has been allotted to every sample of the partially compressed residual waveform 11, there are surplus allotting bits, another 1 bit is further allotted to the samples from the starting end toward the terminal end. This method of bit allotment is aimed at allotting many bits to the partially compressed residual waveform 11 for the compressed section, thereby reducing the distortion caused by quantization in that section. On the other hand, when time-axis compression is executed for the block 2, similar bit allotment is executed from the terminal end toward the starting end of the partially compressed residual waveform 11.

When the input partially compressed residual waveform 11 is judged not to have been subjected to time-axis compression, the residual quantizing means 12 uniformly allots 1 quantization bit to each sample.

The decoding portion shown in FIG. 1B will now be explained.

The residual inverse quantizing means 17 calculates the number of samples of the quantized residual 13 and the number of quantization allotting bits for each sample from the pitch period 8 and the compression control information 10, thereby obtaining the partially compressed residual waveform 18 by the inverse quantization of the quantized residual 13.

The residual partially expanding means 19 expands the time axis of the portion of the partially compressed residual waveform 18 which has been subjected to time-axis compression on the basis of the pitch period 8 and the compression control information 10, thereby obtaining and outputting the reproduced residual waveform 20. The operation of the residual partially expanding means 19 will be explained in detail in the following.

When the input partially compressed residual waveform 18 is judged to have been subjected to time-axis compression for the block 1 from the compression control information 10, the residual partially expanding means 19 expands in succession the partially compressed residual waveform 18 in a one-pitch section to a length corresponding to the two-pitch section by using the following equation (2) from the starting end toward the terminal end of the partially compressed residual waveform 18:

$$\hat{RS}_i = RC_i$$

$$\hat{RS}_{i+p} = RC_i \ (i=\phi,\ p-1) \qquad (2)$$

wherein $RC_i$ represents the partially compressed residual waveform for a one-pitch section of the compressed portion, $RS_i$ the residual waveform after expansion. For the purpose of simplifying explanation, the range of the pointer i is assumed to be from $\phi$ to $P-1$. The expansion processing is continued until the total length of the reproduced residual waveform expanded reaches not less than half of the frame length N (i.e., not less than the length of the block 1).

When the input partially compressed residual waveform 18 is judged to have been subjected to time-axis compression for the block 2 from the compression control information 10, the residual partially expanding means 19 expands in succession the partially compressed residual waveform 18 in a one-pitch section to a length corresponding to the two-pitch section from the terminal end toward the starting end of the partially compressed residual waveform 18 so as to obtain the reproduced residual waveform. In this case, the expansion processing is also continued until the total length of the reproduced residual waveform expanded reaches not less than half of the frame length N. FIGS. 2A, 2B and 3A, 3B show the residual partially expanding operation.

When the input partially compressed residual waveform 18 is judged not to have been subjected to time-axis compression, the residual partially expanding means 19 outputs the residual waveform 18 as it is without executing expanding operation.

Since the time-axis compression ratio (length of the waveform after compression/length of the waveform before compression) of the residual waveform compressed by the residual partially compressing means in the present invention varies in accordance with the pitch period, change in the time-axis compression ratio is taken into consideration.

It is now assumed that the residual waveform for at least two pitch period sections exists in the frame having a length of N. In the case of compressing the time axis of the residual waveform for a block (length: N/2) by the method described in the above explanation of the operation of the residual partially compressing means, if the length of the residual waveform being compressed is within the corresponding block, in other words, if the length N/2 of the block agrees with twice of the pitch period length, namely, 2P, only the time axis of the residual waveform in the corresponding block is reduced to ½ (the entire length of the partially compressed residual waveform becomes ¾·N), and the time-axis compression ratio becomes maximum at this time. When the length N/2 of the block agrees with the pitch period length P, the time axis of the entire waveform in the frame is reduced to ½ (the entire length of the partially compressed residual waveform becomes ½·N), and the time-axis compression ratio becomes minimum at this time. Accordingly, if the compression ratio of the residual waveform compressed by the residual partially compressing means in accordance with the present invention is assumed to be R, R is in the range represented by the following inequality (3):

$$\frac{1}{2} \leqq R \leqq \frac{3}{4} \qquad (3)$$

In this embodiment, the partially compressed residual waveform after the time-axis compression by means of the residual partially compressing means is quantized by the residual quantizing means as it is in the coding portion. Alternatively, the pitch predictive coefficient may be obtained in addition to the pitch period by the pitch analyzing means so as to subject the partially compressed residual waveform to pitch predictive inverse filtering prior to the quantization by the residual quantizing means. In this case, it is necessary that the decoding portion subjects the partially compressed residual waveform after the residual inverse quantization to pitch predictive synthetic filtering.

While there has been described what is at present considered to be a preferred embodiment of the invention, it will be understood that various modifications may be made thereto, and it is intended that the appended claims cover all such modifications as fall within the true spirit and scope of the invention.

What is claimed is:

1. A speech coding apparatus used for the linear predictive coding of an input speech signal, said apparatus comprising:

a linear predictive analyzing means for calculating a linear predictive coefficient by the linear predictive analysis of the waveform of an input speech signal for every predetermined analysis frame;

a linear predictive inverse filtering means for obtaining a linear predictive residual signal from said speech signal by using said linear predictive coefficient calculated by said linear predictive analyzing means;

a pitch analyzing means for calculating the pitch periods of the waveform of said linear predictive residual signal and for calculating the strength of the correlativity between the pitch periods of the waveform of said linear predictive residual signal for each of a plurality blocks which constitute said analyzing frame;

a residual signal partially compressing means for compressing the time axis of said linear predictive residual signal for each block correspondence with said strength of correlativity of said waveform calculated by said pitch analyzing means; and a residual signal quantizing means for quantizing said linear predictive residual signal which has been subject to time-axis compressing by said residual signal partially compressing means and for generating a quantized linear predictive residual signal.

2. A speech coding apparatus according to claim 1, further comprising a multiplexing means for multiplexing a linear predictive coefficient signal output from said linear predictive analyzing means, a pitch period signal output from said pitch analyzing means, a compression information relating to a compressing block and a compressing state which is output from said residual signal partially compressing means and a quantized linear predictive residual signal output from said residual signal quantizing means, and outputting the thus-obtained signal to a transmission path.

3. A speech coding apparatus according to claim 1, wherein said residual signal partially compressing means compresses only the time axis of said linear predictive residual signal for the block in which said strength of correlativity of said waveform calculated by said pitch analyzing means is not less than a predetermined threshold value and is larger than the strength of correlativity of said waveform in another block.

4. A speech coding apparatus according to claim 3, said residual signal partially compressing means compresses the time axis of said linear predictive residual signal for every two adjacent pitch period sections in said block into a residual signal for one pitch period section repeatedly in accordance with the following equation:

$$RC_i=(RS_i+RS_{i+p})/2$$

wherein $RC_i$ represents the linear predictive residual signal waveform in a one-pitch period section after compression, $RS_i$ the linear predictive residual signal waveform in a one-pitch period section before compression, and $RS_{i+p}$ the linear predictive residual signal waveform in a one-pitch period section adjacent to $RS_i$ before compression.

5. A speech coding apparatus according to claim 1, wherein said residual signal quantizing means quantizes said linear predictive residual signal which has been subjected to time-axis compressing by preferentially allotting quantization allotting bits to said linear predictive residual signal for the block which has been subjected to time-axis compressing by said residual signal compressing means.

6. A speech coding apparatus according to claim 5, wherein said residual signal quantizing means allots 1 bit from a predetermined number of bits to all samples of said linear predictive residual signal in said analysis frame and further allots 1 bit from the bits remaining after allotment to each sample of said linear predictive residual signal in the block which has been subjected to time-axis compression, thereby quantizing said linear predictive residual signal.

7. A speech coding apparatus used for the linear predictive coding of an input speech signal, said apparatus comprising:

a linear predictive analyzing means for calculating a linear predictive coefficient by the linear predictive analysis of the waveform of an input speech signal for every predetermined analyzing frame;

a linear predictive inverse filtering means for obtaining a linear predictive residual signal from said speech signal by using said linear predictive coefficient calculated by said linear predictive analyzing means;

a pitch analyzing means for calculating the pitch periods of the waveform of said linear predictive residual signal and for calculating the strength of the correlativity between the pitch periods of the waveforms of said linear predictive residual signal for each of a plurality of blocks which constitute said analyzing frame;

a residual signal partially compressing means for compressing only the time axis of said linear predictive residual signal for every two adjacent pitch period sections for the block in which said strength of correlativity of said waveform calculated by said pitch analyzing means is not less than a predetermined threshold value and is larger than the strength of correlativity of said waveform in another block into a residual signal for one pitch period section repeatedly in accordance with the following equation:

$$RC_i=(RS_{i+p})/2$$

wherein $RC_i$ represents the linear predictive residual signal waveform in a one-pitch period section after compression, $RS_i$ the linear predictive residual signal waveform in a one-pitch period section before compression, and $RS_{i+p}$ the linear predictive residual signal waveform in a one-pitch period section adjacent to $RS_i$ before compression;

a residual signal quantizing means for quantizing said linear predictive residual signal by allotting 1 bit from a predetermined number of bits to all samples of said linear predictive residual signal and further allotting 1 bit from the bits remaining after allotment to the samples of said linear predictive residual signal in the block which has been subjected to time-axis compression and for generating a quantized linear predictive residual signal; and a multiplexing means for multiplexing a linear predictive coefficient signal output from said linear predictive analyzing means, a pitch period signal output from said pitch analyzing means, a compression information relating to a compressing block and a compressing means and a quantized linear predictive residual signal output from said residual signal quantizing means, and outputting the thus-obtained signal to a transmission path.

8. A speech decoding apparatus for decoding a speech signal which is linear predictively coded with a part thereof subjected to time-axis compression by a speech coding apparatus having a residual signal partially compressing means, said apparatus comprising:

a separating means for separating from an input signal a linear predictive coefficient signal, a quantized linear predictive residual signal, a pitch period signal of said linear predictive residual signal and a compressing signal relating to a time-axis compressed portion and a compressed state;

a residual signal inverse quantizing means for inversely quantizing said quantized linear predictive residual signal which is separated by said separating means;

a residual signal partially expanding means for partially expanding said linear predictive residual signal which is inversely quantized by said residual signal inverse quantizing means on the basis of said pitch period signal and said compression signal which are separated by said separating means; and a linear predictive synthetic filtering means for obtaining a speech signal from said linear predictive residual signal which is partially expanded by said residual signal partially expanding means on the basis of said linear predictive coefficient signal which is separated by said separating means.

9. A speech decoding apparatus according to claim 8, wherein said residual signal inverse quantizing means inversely quantizes said quantized linear predictive residual signal by calculating the number of quantized samples and the number of bits allotted to each quantized sample from said pitch period signal and said compression information which are separated from said separating means.

10. A speech decoding apparatus according to claim 8, wherein said residual signal partially expanding means repeats expansion on said linear predictive residual signal which has been subjected to time-axis compression by said residual signal partially compressing means in said speech coding apparatus for one pitch period section to a signal for two pitch period sections in accordance with the following equations on the basis of said pitch period signal and said compression information which are separated by said separating means:

$$RS_i = RC_i$$

$$RS_{i+p} = RC_i$$

wherein $RC_i$ represents the linear predictive residual signal waveform in a one-pitch period section before expansion, $RS_i$ the linear predictive residual signal waveform in a one-pitch period section after expansion, and $RS_{i+p}$ the linear predictive residual signal waveform in a one-pitch period section adjacent to $RS_i$ after expansion.

* * * * *